US005644801A

United States Patent [19]

Zhao et al.

[11] Patent Number: 5,644,801

[45] Date of Patent: Jul. 8, 1997

[54] SPLASH-REDUCED TOILET SYSTEM

[76] Inventors: Shurun Zhao, 2221 Houma Blvd., Apt. 230, Metairie, La. 70001; Gang Zhao, Law Office Huangdao District, Qingdao, China

[21] Appl. No.: 541,339

[22] Filed: Oct. 10, 1995

[51] Int. Cl.[6] ..... E03D 9/00

[52] U.S. Cl. ..... 4/300.3; 4/661

[58] Field of Search ..... 4/300.3, 661

[56] References Cited

U.S. PATENT DOCUMENTS

| | | |
|---|---|---|
| 2,689,353 | 9/1954 | Schuster . |
| 3,383,710 | 5/1968 | Sumner . |
| 4,010,497 | 3/1977 | Menter et al. . |
| 4,062,070 | 12/1977 | Prince . |
| 4,566,214 | 1/1986 | McCrory et al. . |
| 4,890,339 | 1/1990 | Clark . |

FOREIGN PATENT DOCUMENTS

| | | | |
|---|---|---|---|
| 2052789U | 8/1989 | China . | |
| 2170334Y | 10/1993 | China . | |
| 35379 | 8/1913 | Sweden | 4/300.3 |

*Primary Examiner*—David J. Walczak
*Attorney, Agent, or Firm*—C. Emmett Pugh; Pugh/Associates

[57] ABSTRACT

A toilet system for reducing or eliminating the splash and noise normally associated with human waste as it falls and penetrates the surface of the water contained in a toilet bowl (10). This system includes a floating object or deflector (20) positioned at the surface of the water which functions to deflect the fall of the waste matter. An electrical circuit (1–6) generates an electromagnetic field, which interacts with the magnetic influenceable material of the deflector and/or a permanent magnet connected to the floating deflector. Interaction between the electromagnetic field and the magnetic influenceable material (e.g. iron) or permanent magnet allows the floating object to be maintained at a predetermined, centralized and depth position on the surface of the water. By manually operating and moving the control (4) on a variable resistor in the electrical circuit, the strength of this electromagnetic field is adjusted, causing the floating object to move about at the water surface, effectively rinsing and cleaning the floating object's surfaces. The electrical circuit also includes a switch (14–17) which is physically incorporated into the operation of the toilet reservoir tank such that when the toilet is flushed, the switch is open and the electromagnetic field is inactive, allowing the deflector to fee float, and when the reservoir is full, the switch automatically closes and the electromagnetic field is activated, controlling the position of the floating deflector. A number of different deflector designs are illustrated in FIGS. 2A–2J.

21 Claims, 2 Drawing Sheets

SPLASH-REDUCED TOILET SYSTEM

TECHNICAL FIELD

The present invention relates to toilets and more particularly to a system for reducing, if not eliminating, the splash and noise created in toilet bowls as human waste drops into the water-filled bowl, by employing a floating deflector positioned at the surface of the water. More specifically, the present invention is directed to improvements in floating deflectors when an electromagnet is introduced to interact with a permanent magnet located adjacent the floating deflector.

In this system, the floating deflector functions to intercept falling waste matter which would otherwise splash the water and to allow the landed waste matter to quietly slide off the deflector surface and into the toilet water. The magnetic force between the electromagnet and the permanent magnet helps to maintain the floating deflector at a pre-determined optimal location in the bowl. Furthermore, the system provides for a method of rinsing the floating deflector by manipulating the magnetic force between the two magnets such that the floating deflector is caused to move about in an up-and-down manner in the water.

BACKGROUND ART

The conventional toilet system is almost universally known and used. It includes a bowl normally filled with water, and a reservoir tank positioned typically behind and above the bowl or otherwise associated with the bowl. The reservoir contains a sufficient volume of water to flush the bowl upon operation of a hand lever outside the reservoir. The bowl typically is outfitted with a pronounced rim on its top perimeter and a hinged seat above the rim. The user may sit on the seat to defecate or urinate into the water-filled bowl, or may lift the seat to urinate. When the toilet is flushed, the dirty water leaves the bowl through a trap and piping behind the toilet and enters the service sewer line.

A problem with using the conventional toilet is that a splash and a noise is created when fecal matter or urine drops into the water-filled bowl. The resultant spattering deposits waste particles on the walls of the bowl above the water line, on the rim, under the seat, or on the user's bottom. Flushing does not always rinse the walls and rim free of the deposited waste particles.

Waste particles deposited on the toilet surfaces are, of course, unsightly and produce an undesirable odor. The unsanitary condition also promotes the spread of disease, especially if there is direct contact between the user and the germ-laden toilet water. Moreover, the noise accompanying the splash can be embarrassing to some users.

A list of prior patents which may be of interest is provided below:

| U.S. Pat. No. | Inventor(s) | Issue Date |
|---|---|---|
| 2,689,353 | Schuster | 09/21/54 |
| 3,383,710 | Sumner | 05/21/68 |
| 4,010,497 | Menter et al | 03/08/77 |
| 4,062,070 | Prince | 12/13/77 |
| 4,566,214 | McCrory et al | 01/28/86 |
| 4,890,339 | Clark | 01/02/90 |

Note is also made of Chinese patent documents CN 2052789U (89209389.7; Aug. 1, 1989) and CN 2170334Y (93242321.3; Oct. 15, 1993).

There are, in the prior art, proposed methods for eliminating or reducing the splashing of the toilet water and the noise that accompanies it. For example, inventors have modified the inside contours of the toilet bowl so that the waste matter first strikes the wall or an add-on before sliding below the water surface (see U.S. Pat. No. 2,689,353 to Schuster and Chinese Patent Document 2170334Y). Schuster ('353) discloses a cross member extended diametrically and horizontally across the bowl just below the water surface. The cross member breaks the fall of dropping feces or urine in the hope of eliminating splashing.

Another approach is to alter the water surface on which the falling waste drops. In U.S. Pat. No. 4,890,339 to Clark, an anti-splash device includes a submerged motor-driven rotor for creating hydraulic turbulence at the surface. Instead of a static surface, the waste matter meets a turbulent surface which counteracts the impact of the falling waste matter and suppresses the splash effect that normally follows penetration of the surface.

The primary problem associated with the previously mentioned prior art is that the anti-splash device and its accessories have a tendency to collect waste particles and are difficult to clean. Furthermore, in light of the simplicity of the conventional toilet, any substantial modification to its construction has the potential of adversely affecting its usually efficient operation, e.g. disrupt the flushing action.

A much simpler alternative is provided by another class of anti-splash device which position barriers or deflectors near the surface of the water to break the fall of the waste matter. Ideally, the waste matter will then slide off the deflector and into the water.

In U.S. Pat. No. 4,010,497 to Menter et al, the barrier takes the form of a disposable paper product which floats on the surface of the water. Although this system addresses the self-cleaning concern, other problems persist. One, the system requires that a stock of the disposable paper is kept nearby. The user must deposit new paper into the bowl before or after each use. Another potential problem is that the disposable paper has limited capacity to handle large amounts of waste matter. The paper ultimately sinks, disintegrates or otherwise moves away from the center of the bowl. If the toilet must be flushed before the user completes his act, that user must throw in new paper before continuing. Lastly, the disposable paper exacerbates the danger of clogging the toilet pipes.

A unique treatment to the water surface is disclosed in U.S. Pat. No. 3,383,710 to Sumner, issued in 1964. In this disclosure, a chemical is added to the water to form a layer of foam at the surface through which the wastes are passed. The foam is intended to cushion the impact of the falling water and also suppresses any dispersion of water from the surface. However, this concept is not feasible because the foam-making chemicals have not been widely tested and are not readily available.

Perhaps the most relevant prior art is the floating deflector illustrated in U.S. Pat. No. 4,062,070 to Prince. That particular toilet system employs a floating deflector for receiving and dispersing a urine stream. The floating deflector has the form of a sphere or polyhedron, typically with a smooth and steep surface so as to facilitate urine dispersion. This anti-splash device, however, is directed strictly to deflection of a urine stream. It is not as effective with solid waste. The deflector does not stay in the center of the bowl but floats freely about the water surface. A non-rigid connector attached to the wall of the toilet is the only restraint.

The Chinese patent document CN 2052790U discloses a complexly curved object (ball within a "doughnut") which apparently is used as a floating member in the toilet bowl tethered to a ring apparently associated with the upper rim of the toilet bowl or to the bottom of the toilet seat. It would appear that such a shape would serve to at least temporarily trap any fecal matter and urine between the sides of the inner ball and the inner diameter portion of the "doughnut" or torroidal shape.

The present invention avoids or corrects the problems specific to the Prince '070 deflector, as well as the problems and inconveniences associated with the above discussed prior art. Furthermore, the present invention provides an effective method of reducing, if not generally eliminating, the splash and noise created when waste matter drops into toilet water.

It is noted that, although U.S. Pat. No. 4,566,214 to McCrory et al has been cited above, its disclosure is not relevant prior art under 35 U.S.C. §103 since it involves a technical field (viz., waterfowl decoys) unrelated to the technical field (viz., toilet systems) of the present invention. This patent is directed to a non-analogous waterfowl decoy featuring electro-mechanical means for lifelike motion when operated upon water, causing the decoy to move continuously and produce a continuous outflow of ripples upon the water surrounding it to bring live waterfowl's attention to it.

GENERAL SUMMARY DISCUSSION OF INVENTION

Thus, the present invention is directed to solving or at least substantially reducing the problem of toilet water splashing and spattering on to the walls, rim or seat of the toilet, or onto the user, when solid waste or urine would otherwise strike the water contained in the toilet bowl. More specifically, the present invention is directed to providing a splash-reduced toilet system comprising a conventional toilet bowl and reservoir, a floating deflector positioned inside the toilet bowl made of magnetically influenced material (e.g. iron) or having one or more permanent magnet(s) located inside or adjacent the floating deflector, and a source of a magnetic field produced externally to the floating object or deflector created preferably by an associated electromagnet which interacts with the magnetic material or permanent magnet of the floating deflector. The phrase "magnetic influenceable material" refers to a part of the floating object that can either be in the form of a material such as, for example, iron or a magnetic material, such as a permanent or electro- magnet, in which the strengths of the material and the magnetic field associated with the toilet bowl are such that the field's interaction with the material is sufficiently strong that the floating object is moved or caused to remain in a certain position.

An external magnetic or electromagnetic field is central to the operation of the system. In the preferred, exemplary embodiment it is generated by, for example, a transformer bridge circuit comprising an AC power source, a switch, a bridge rectifier with a DC output, a capacitor, a variable resistor, and an electromagnet located preferably within the structure of the toilet bowl below the floating deflector. Alternatively, a permanent magnet could be used.

The preferred electromagnet produces a temporary magnetic field utilizing a solenoid with, for example, an iron core. When current flows through the coil of the solenoid, the electromagnetic field is generated, producing an effective magnetic field of influence in the direction of the floating deflector with its magnetic material and/or permanent magnet.

Typically, the electromagnet is positioned at a central location below the toilet bowl with the central axis of the magnetic field aligned perpendicular to the horizontal water surface. The magnetic field acts on the deflector's magnetic influenceable material or permanent magnet to position the floating deflector at or around the center of the water surface directly above the electromagnet and pulled down a bit lower than its inherent buoyancy would produce. At that location, the floating deflector intercepts falling waste matter which would otherwise strike the water surface. The waste lands momentarily on top of the deflector before sliding off its smooth, steep or downwardly biased surface(s).

The position of the floating deflector is initially disturbed by the falling matter but buoyant forces and the magnetic field both act to return the deflector to its original, centralized position. The present invention is unique in that inter alia the floating deflector retains a central position in the toilet bowl without the aid of mechanical or physical restraints, connections or tethers.

The body of the floating deflector is designed to achieve the optimal balance of buoyancy, a facility for self-cleaning, and stability while also accommodating any associated permanent magnet(s). When the floating deflector is at equilibrium, buoyant forces exert pressure along the immersed portions of the floating body, preferably perpendicular to the body, while the magnetic field typically exert a force in the downward direction (via the permanent magnet), causing the body to be partially submerged.

It is desired that the floating deflector achieve an equilibrium state slowly after a disturbance. A less stable design that is more sensitive to disturbances caused by falling waste or changes in the strength of the electromagnetic field is more conducive to self-cleaning and rinsing. In the preferred embodiment, the floating deflector is a plastic sphere with a permanent magnet positioned within it. This design currently appears to achieve the best results.

The floating deflector may also be rinsed, upon demand, by varying the strength of the electromagnet. As explained more fully below, the relative strengths of the magnetic and buoyant forces exerted on the floating body determine the degree of submergence of the floating deflector. This equilibrium is disturbed when the strength of the electromagnetic field is adjusted, as when the resistive elements of the variable resistor in the bridge circuit is adjusted or changed. The floating deflector can be moved about in this manner, including in an up and down motion, or a more complex motion. As a result, the floating deflector is vigorously rinsed and cleaned. An manually operable switch for the variable resistor may be located on the reservoir or any place accessible to the user.

Another important feature of the present invention is the automatic operation of an "on"/"off" switch used to automatically open the electromagnetic circuit, killing the electromagnetic force, when the toilet is flushed, allowing the floating deflector to freely float during the flushing operation, and then automatically re-energize after the flushing operation is completed. This automatic "on"/"off" switch preferably is physically located inside the reservoir.

When the toilet is flushed and the water level in the reservoir begins to fall, the switch operated by a float automatically opens and the electromagnetic field is rendered inactive. Acting alone, the buoyant forces then keep the deflector above water and help prevent it from being sucked down to the discharge opening. However, the size of the deflector typically would be larger than the opening, absolutely preventing any possibility of it being flushed out of the toilet bowl.

When the water level in the reservoir is again filled, the float for the switch rises and the switch is closed, activating and re-energizing the electromagnetic field. Consequently, the sphere returns to its pre-determined central location and ultimately rests in a partially submerged condition, pulled down in part by the electromagnetic field, as well as the buoyancy neutralized weight of the floating deflector.

The floating object or deflector can take many different shapes and configurations, although it is highly desirable that the upper side be laterally extended and have downwardly sloping sides to allow for enhanced sliding of solid and liquid matter from the upper side or top surfaces of the object. It if further desirable that there not be trapping surfaces on the top side which would trap and contain the waste matter.

The floating object must interact with and be influenced by the external magnetic field by, for example, either being made at least in part of a material, such as iron, which significantly interacts with and is effected by an externally applied magnetic field and/or by including one or more permanent magnets associated with it, for example, suspended within the body of the floating object or otherwise associated with it.

Additionally, although an electromagnetically based system is the most preferred, permanent magnets could also alternatively be used to generate the external magnetic field to work with the magnetic field influenced floating deflector.

It is thus an object of the invention to eliminate or substantially reduce the splash and noise resulting from the disposal of fecal matter or urine into a conventional toilet by providing a floating deflector strategically positioned on the surface of the toilet water.

It is a further object of the invention to provide a splash-reduced toilet system which does not affect the construction and operation of the conventional toilet.

It is still a further object of the invention to provide for an anti-splash device that requires little or no maintenance and does not require replacement after every flush.

It is still a further object of the invention to provide, in a splash-reduced toilet system, a floating deflector which is self-cleaning and maintains its optimal position at all times.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
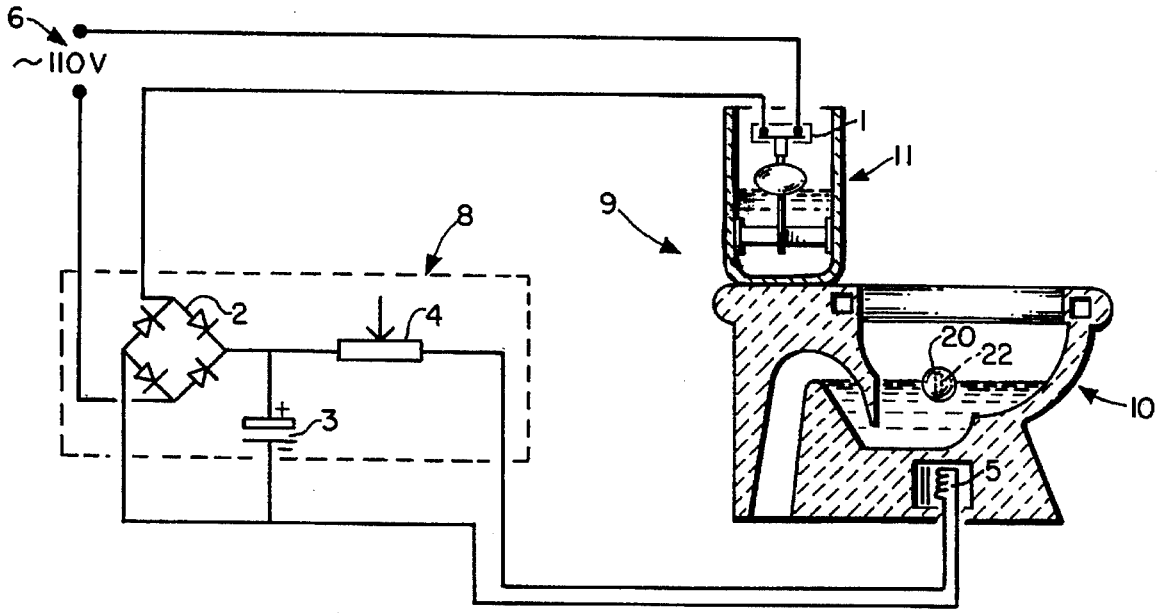
FIG. 1 is a side, cross-sectional view of the preferred, exemplary embodiment of the toilet system of the present invention, including an exemplary toilet and the floating deflector, along with a schematic of the electrical circuit used to generate the appropriate electromagnetic field used in association with the floating deflector.

An exemplary, preferred embodiment of the splash-reduced toilet system 10 of the invention, as shown in FIG. 1, includes a toilet bowl 10, a reservoir 11 filled with water, a floating deflector 20, and an electrical circuit 8 for generating an electromagnetic field that interacts with a permanent magnet 22 adjacent, or located within, the floating deflector 20. By interacting with the permanent magnet 22, the electrical circuit 8 effectively interacts with floating deflector 20. The electromagnetic field functions to position floating deflector 20 at a pre-determined central location on the surface of the water, to return floating deflector 20 to that position whenever it is disturbed, and to provide the means for remotely manipulating floating deflector 20 for the purpose of self-rinsing and cleaning.

The electromagnetic field is generated by the electrical transformer bridge circuit 8 shown in FIG. 1. The bridge circuit 8 comprises an AC power source 6, a variable, flush de-activation switch 1, a full-wave bridge rectifier 2 for transforming an AC input into a DC output, a capacitor 3, a variable resistor 4, and an electromagnet 5. Each of these circuit elements are commonly known. It is important to note, however, that the desired electromagnetic field may be generated by alternative means and by other known circuits.

Figure 1A:
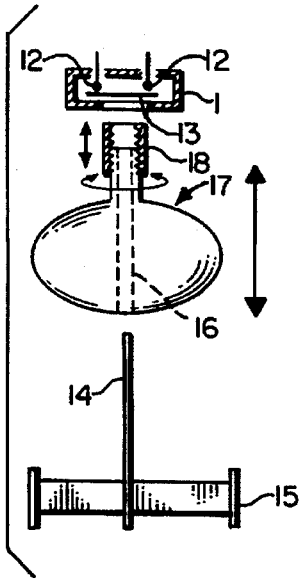
FIG. 1A is a detailed, simplified, exploded view of the "on"/"off" switch related structure of the circuit for the electromagnet shown in FIG. 1 for automatically opening the circuit and shutting off the electromagnet when the toilet is flushed.
Figure 1B:
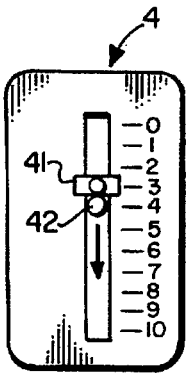
FIG. 1B is a frontal view of a switch for the user to initiate the cleaning cycle for driving or causing the deflector to move up and down and about in the water to clean it off.
Figure 1C:
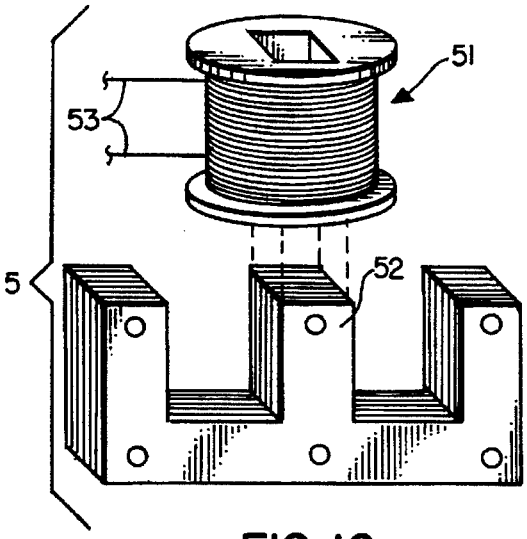
FIG. 1C is a side, simplified, exploded view of an exemplary electromagnet used in the exemplary circuit of FIG. 1.

A detailed illustration of electromagnet 5 is provided as FIG. 1C. Electromagnet 5 includes a solenoid 51 and an iron core 52. When current flows through the coils 53 of solenoid 51, the electromagnetic field is generated and interacts with permanent magnet 22 of the floating deflector 20. The reaction of the floating deflector 20 will depend on the alignment of the permanent magnet 22 relative to the electromagnet 5, and the strength of the permanent magnet 22 and that of the generated electromagnetic field.

Variable resistor 4 or potentiometer is typically a potentiometer with adjustable or moveable means for adjusting the value of the resistive element therein. The variable potentiometer 4 may be mounted on the outside of the reservoir 11 or another location accessible to the user.

Movement of the spring-biased toggle handle 42 up and down in its slot adjusts the potentiometer 4, varying the current flow to the coils 53 of the electromagnet 5, thereby varying the strength of the electromagnetic field generated and affecting the interaction between the electromagnet 5 and the permanent magnet 22 of floating deflector 20. Typically, an adjustment will cause the floating deflector 20 to at least move linearly, towards or away from the electromagnet 5. Continued up and down manipulation of the toggle handle 42 of the variable potentiometer 4 allows the user to move the floating deflector 20 up and down, or around, thereby effectively rinsing and cleaning the surfaces of floating deflector 20, when so desired, which can be, for example, before and/or after each flush.

An adjustable set member 41 is included to selectively limit the upward movement of the toggle handle 42. Its position will determine the amount of maximum resistance that the potentiometer switch adds to the circuit and hence the minimum strength of the field that the electromagnet 5 will generate, which determines the depth of the floating object will have in the water. The user would typically set this one time to position the floating deflector at the desired depth in the toilet bowl water, overcoming in part the natural buoyancy of the floating deflector 20. The movement of the toggle handle below and back-up to the set position of the set member 41 diminishes the resistance of the potentiometer 4, thereby increasing and decreasing the field strength of the electromagnet 5, causing the floating deflector to suddenly change its depth into the water, washing it off in the water. Depending on the particular design of the floating deflector (note the alternative designs of FIGS. 2A–2J), the induced movement can be quite complex, enhancing the washing action.

FIG. 1A illustrates the operation of the flush de-activation, water-proof switch 1. The switch 1 is physically located inside the reservoir 11. Normally, switch 1 is closed and the electrical circuit 8 is energized. However, when the toilet 9 is flushed, it is desirable to deactivate the electromagnetic field so that only buoyant forces are exerted on floating deflector 20 without opposition from the magnetic field. The floating deflector 20 is maintained above water and the danger of inadvertently flushing the floating deflector 20 is significantly reduced. When the reservoir 11 returns to its normal full condition, switch 1 is automatically closed and the circuit 8 is again energized.

To achieve this sequence of automation, the vertically extended bar member 14, which is held fixed within the reservoir tank 11 by the bracing structure 15, travels up and down through the length of the internal guide 16 in the float 17 with the ebb and rise of the water level in reservoir 11, holding the float in place within the reservoir tank 11. When the toilet 9 is flushed and the water level in the tank 11 drops, the float 17 drops down (note larger, vertical, double-tipped, directional arrow) away from the contact switch 1, opening it and de-energizing the electromagnetic circuit 8. When the water again fills the tank 11 and the float then rises back up, at the end of its travel the adjustable tip 18 of the float 17 pushes the contact arm 13 up to engage the terminals 12, thereby closing and energizing the circuit 8. The upper tip 18 of the float 17 is rotatably threaded (note double-tipped curved directional arrow in FIG. 1A) to the float, allowing the effective length of the float 17 (note smaller, double tipped directional arrow) to be varied to adjust it within the switching system. The relative position of the tip 18 on the float 17 would normally be set once at the time of the installation of the switch 1 and its associated mechanism 14–18 in the tank 11, which relative position can thereafter be adjusted as needed during the on-going use of the system.

The particulars of the activation and de-activation switch 1, the "washing" switch 4 and the circuit 8 are, of course, subject to much variation, and the foregoing details are merely exemplary of one possible system.

FIG. 1 shows the electromagnet 5 positioned at a central location below the toilet bowl 10. The floating deflector 20 then retains the position directly above electromagnet 5, on the surface of the water inside the bowl 10. In alternative embodiments, electromagnet 5 may be positioned at other locations around the toilet bowl 10, either internally as illustrated or externally.

The primary function of the floating deflector 20 is to intercept waste matter which would otherwise splash into the toilet water. The body of the deflector 20 is designed to achieve a balance between favorable buoyancy characteristics, a sensitivity to external forces, e.g. falling waste matter, a facility for self-rinsing and cleaning, and the demands of the permanent magnet 22. FIGS. 2A–2J illustrate alternative embodiments of the floating deflector 20, illustrating variations in the design of the permanent magnet and the deflector body. For the most part, the variations shown or described in this disclosure are interchangeable.

Figure 2A:
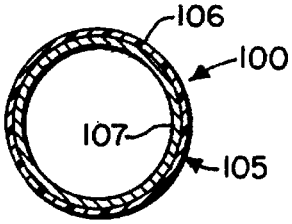
FIGS. 2A–2J are side, simplified views of alternative embodiments of the floating deflector, some of which include a permanent magnet.

In the preferred embodiment of FIG. 2A, the floating deflector 100 is a hollow sphere. The sphere 100 is constructed of a wall 105 with two layers, an outer layer 106 and an inner layer 107. The outer layer 106 is preferably a plastic shell or liner, providing a smooth outer surface 101 on which landed waste matter slides off easily. The smooth surface 101 and round contours also makes the sphere 100 easier to rinse and clean. Inner layer 107, typically a ferrous material, functions as a permanent magnet and interacts with the electromagnetic field generated by circuit 8.

Figure 2B:
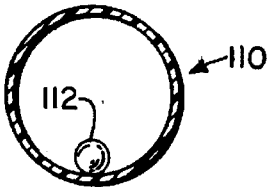

In the alternative embodiment shown in FIG. 2B, the permanent magnet 112 is a metallic ball positioned inside the sphere 110, typically constructed of iron and having a diameter substantially less than the sphere 110. The iron ball 112 is free to move about the sphere 110.

Figure 2C:
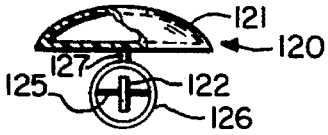

In FIG. 2C the flotation deflector 120 takes the form of a partial section of a sphere 121. The permanent magnet 122 is a disk pivoted about its axis with its shaft 125 pinned to the inside of ring 126. Ring 126 and permanent magnet 122 are positioned directly below the partial sphere 121. A plastic stem 127 connects the two elements by conventional methods, e.g. by adhesives or by fasteners. Upon introduction to the magnetic field, the disk 122 rotates about its axis in alignment. A similar disk is used in the flotation deflectors of FIGS. 2E, 2F and 2G.

Figure 2D:
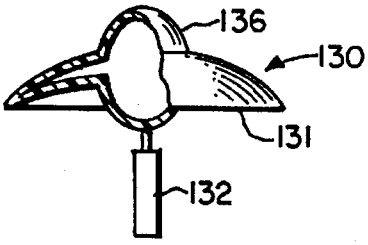

The form of flotation deflector 130 shown in FIG. 2D is a combination of a sphere 136 and a spherical section 131. The permanent magnet 132 is an elongated bar or rod positioned below the deflector 130 and connected to it by conventional means. A similar permanent magnet 172 is used with the flotation deflector 170 of FIG. 2H. Whereas the ball and disk type magnets cause a more erratic motion in the floating deflector 20, the bar or rod magnets provide more of an up-and-down or linear manipulation of the floating deflectors when influenced by the electromagnetic field.

Figure 2E:
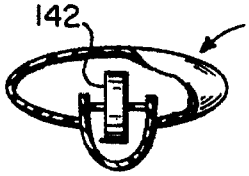
Figure 2F:
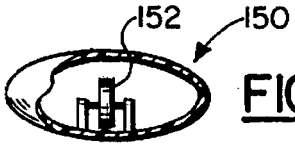
Figure 2G:
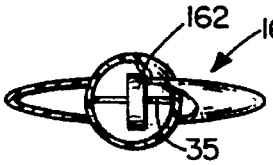
Figure 2H:
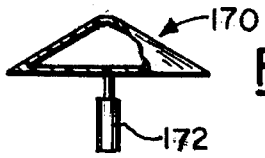

Further variations in the deflector body are illustrated in the pyramid of FIG. 2H, the oval figure deflector 140 (with magnet 142) and deflector 150 (with magnet 152) of FIGS. 2E and 2F respectively, and the combination ring and disk figure deflector 160 (with magnet 162 held by shaft 35) of FIG. 2G.

Figure 2I:
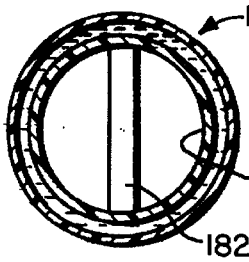

The floating deflector 180 of FIG. 2I is a sphere which contains an inner sphere 185, wherein liquid is contained between the two spheres 180, 185. The inner sphere 185 houses the permanent magnet 182. In this embodiment, the permanent magnet 182 may be a fixed disk, rod or bar. When the magnet 182 interacts with the electromagnetic field, the inner sphere will be moved within and about the outer sphere, adding to the complexity of the motion of the deflector during the cleaning stage. This particular design thus also causes erratic movement of the floating deflector 180.

Figure 2J:
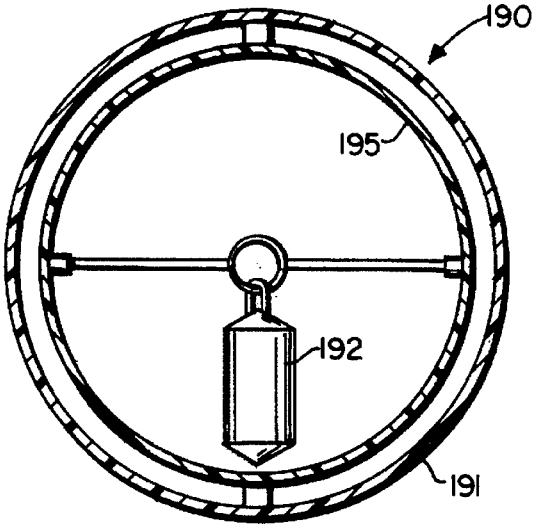

The floating deflector 190 of FIG. 2J is a sphere which contains an inner support frame 195 affixed to the interior of the sphere 191. The inner support framework 195 flexibly supports an off-set permanent magnet 192. In this embodiment, the permanent magnet 192 may also be a fixed disk, rod or bar. When the magnet 192 interacts with the electromagnetic field, it will move about within the sphere 191 flexibly constrained by the flexible framework support subsystem 195 and will move within and about the interior of the outer sphere 191 in a complex motion, adding to the complexity of the motion of the deflector during the cleaning stage. This particular design thus also causes erratic movement of the floating deflector 180.

It is noted that the embodiments described herein in detail for exemplary purposes is of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A toilet system, comprising:

a toilet bowl partially filled with water;

a reservoir tank filled with water associated with said toilet bowl;

a floating object floating in said toilet bowl for deflecting matter that falls into the toilet bowl, said floating object being positioned at the surface of the water inside the bowl; and magnetic means associated with said toilet bowl for generating an magnetic field to interact with and influence the position of said floating object as it floats in said toilet bowl.

2. The toilet system of claim 1, wherein:

said floating object includes a connected permanent magnet to interact with the magnetic field.

3. The toilet system of claim 1, wherein:

said floating object is made at least in part of a magnetically influenceable material to interact with the magnetic field.

4. A toilet system of claim 1, wherein said magnetic means comprises an electromagnetic system located in association with the toilet bowl to generate an electromagnetic field effectively interacting with said floating object to move and locate it within said toilet bowl.

5. The toilet system of claim 4, wherein:

the electromagnetic field is generated by an electric circuit including an electrically interconnected AC power source, "on"/"off" switch means, a variable resistor means, and an electromagnet.

6. The toilet system of claim 5, wherein:

said variable resistor means is manually operable by the user for varying the strength of the electromagnetic field and for variably interacting with the floating object to remotely move the floating object about in the water, washing it off.

7. The toilet system of claim 5, wherein said switch means includes:

a contact subsystem co-operable with the reservoir tank activating and deactivating said electromagnetic system, wherein, when said reservoir tank is full, said switch is closed and said circuit is energized, and when said reservoir tank is flushed, the switch is opened and said circuit is de-energized.

8. The toilet system in claim 1, wherein said floating object is:

laterally and vertically extended and includes a substantially curved, upper surface having continuously downward sloping sides for intercepting and dispersing into the water, matter that falls into the toilet bowl.

9. An anti-splash toilet system for use with a toilet bowl partially filled with water, comprising:

a buoyant, floating deflector made of magnetically influenceable material floatable in the water in the toilet bowl and being centrally positionable in the toilet bowl to continuously intercept solid or liquid matter that falls into the toilet bowl, while being mechanically independent of and physically unattached to the toilet bowl, and being maintainable in a pre-determined central location in the bowl under the action of a magnetic field; and an associated source of the magnetic field of sufficient strength to hold said floatable deflector in a central location in the toilet bowl.

10. The device in claim 9, wherein said deflector includes a substantially round, top surface for dispersing into the water matter that falls into the toilet bowl.

11. The device in claim 9, wherein said deflector further comprises:

a permanent magnet, said permanent magnet interacting with the magnetic field from said associated source.

12. The device in claim 11, wherein:

said deflector has the form of a hollow sphere; and said permanent magnet is positioned within the hollow sphere.

13. The device in claim 11, wherein said permanent magnet comprises:

an elongated member, said member being connected at one end to said floating deflector.

14. The device in claim 11, wherein said permanent magnet comprises:

a disk pivoted about its axis.

15. The device in claim 11, wherein said associated source is an electromagnet producing an electromagnetic field; and wherein said permanent magnet interacts with the electromagnetic field to influence the positioning of the floating deflector.

16. A method of reducing splash in a toilet bowel containing water produced by fecal matter dropping down into the bowl, comprising the following steps:

providing a magnetically influenceable floating object in a position at the surface of the toilet water to deflect matter that falls into the toilet bowl; and controlling the position of said floating object, both vertically and horizontally, with a magnetic field of a given strength, generated external to the floating object.

17. The method in claim 16, wherein said floating object includes a permanent magnet and an electromagnet is used for said magnetic field, producing an electromagnetic field, and wherein said method further comprises the further step of:

controlling the position of said floating object, both horizontally and vertically, with the electrical magnetic field.

18. The method in claim 16, wherein said floating object includes a permanent magnet and an electromagnet is used for said magnetic field, producing an electromagnetic field, and comprising the further steps of:

using the electromagnetic field for remotely moving the floating object; and using the electromagnetic field for remotely rinsing the floating object.

19. The method of claim 16, wherein the electromagnetic field is generated by an electrical circuit comprising:

a power source;

switch means;

a selectively operable variable resistor means; and an electromagnet; and wherein there is included the further step of:

using said circuit flowing from said power source through said electromagnet to produce the electromagnetic field.

20. The method of claim 19, wherein said switch means includes:

contact means co-operable with a reservoir tank for activating and deactivating said electromagnetic field; and wherein there is included the steps of:

using said contact means to energize the electromagnetic circuit when said reservoir tank is full; and alternatively, using said contact means to de-energize the electromagnetic circuit when the reservoir tank is significantly less than full.

21. The method of claim 19, wherein there is included the steps of:

using said selectively operable variable resistor means to vary the current flowing through said electromagnet, varying the strength of the generated electromagnetic field, causing said floating object to move in a varying motion in the water, washing the object off.

* * * * *